US006962028B2

(12) United States Patent
Banova

(10) Patent No.: US 6,962,028 B2
(45) Date of Patent: Nov. 8, 2005

(54) INTERLOCKING MASONRY ARTICLES AND METHODS THEREOF

(76) Inventor: Aldo Banova, 8105 Amersham Ave., Las Vegas, NV (US) 89129

( * ) Notice: Subject to any disclaimer, the term of this patent is extended or adjusted under 35 U.S.C. 154(b) by 33 days.

(21) Appl. No.: 10/743,446

(22) Filed: Nov. 24, 2003

(65) Prior Publication Data

US 2005/0108972 A1 May 26, 2005

(51) Int. Cl.[7] ..... E04B 2/46

(52) U.S. Cl. ..... 52/592.5; 52/379; 52/505; 52/578; 52/591.1; 52/592.2; 52/596; 52/604; 52/605; 52/606; 52/603

(58) Field of Search ..... 52/505, 578, 591.1, 52/592.5, 596, 603–607, 379, 740.1

(56) References Cited

U.S. PATENT DOCUMENTS

| | | | | | |
|---|---|---|---|---|---|
| 708,499 | A | * | 9/1902 | Searight et al. | 52/592.3 |
| 1,265,447 | A | * | 5/1918 | Havens | 52/281 |
| 1,562,728 | A | * | 11/1925 | Albrecht | 138/115 |
| 1,785,499 | A | * | 12/1930 | Sayers | 52/505 |
| 2,042,992 | A | * | 6/1936 | Hine et al. | 52/591.2 |
| 2,665,032 | A | * | 1/1954 | Foss et al. | 222/74 |
| 2,902,853 | A | * | 9/1959 | Lofstrom | 52/286 |
| 3,650,079 | A | * | 3/1972 | Lubin | 52/316 |
| 4,075,808 | A | | 2/1978 | Pearlman | |
| 4,124,961 | A | * | 11/1978 | Habegger | 52/592.6 |
| 4,207,718 | A | * | 6/1980 | Schaaf et al. | 52/585.1 |
| 4,319,440 | A | * | 3/1982 | Rassias et al. | 52/438 |
| 4,627,209 | A | | 12/1986 | Schwartz | |
| 5,365,714 | A | * | 11/1994 | Potvin | 52/590.2 |
| 5,685,119 | A | * | 11/1997 | Zschoppe | 52/592.5 |
| 5,729,943 | A | | 3/1998 | Cambiuzzi | |
| 5,802,797 | A | * | 9/1998 | Storer-Folt | 52/604 |
| 5,901,520 | A | * | 5/1999 | Abdul-Baki | 52/592.6 |
| 5,992,108 | A | * | 11/1999 | Falcey | 52/220.2 |
| 6,122,881 | A | | 9/2000 | Aubertot | |
| 6,161,357 | A | * | 12/2000 | Altemus | 52/592.6 |
| 6,164,026 | A | * | 12/2000 | Ehrenkrantz | 52/220.2 |
| 6,588,168 | B2 | * | 7/2003 | Walters | 52/604 |

* cited by examiner

*Primary Examiner*—Jeanette E. Chapman
(74) *Attorney, Agent, or Firm*—Harry M. Weiss; Weiss, Moy & Harris, P.C.

(57) ABSTRACT

Each of a plurality of masonry article comprises a contoured first header, a contoured second header, a contoured front face, a back face, a contoured lower base and an upper base. The plurality of masonry articles has a plurality of holes extending from the lower base to the upper base. The contoured first header couples to the contoured second header of another plurality of masonry articles and the contoured lower base couples to the upper base of the other plurality of masonry articles so that an outward face of a portion of a wall assembled with the plurality of masonry articles has a mortar-like vertically oriented gap and a mortar-like horizontally oriented gap. A plurality of corner masonry article and plurality of alternative corner masonry articles similar to the plurality of masonry articles permit assembly of a portion of a corner section of the wall.

19 Claims, 2 Drawing Sheets

INTERLOCKING MASONRY ARTICLES AND METHODS THEREOF

FIELD OF THE INVENTION

This invention relates generally to masonry articles and more specifically to novel interlocking masonry articles and improved construction methods to readily form continuous wall sections with mortar-less joints that have the appearance of mortared joints.

BACKGROUND OF THE INVENTION

In the past, numerous efforts have been made to overcome the shortcomings of various building elements such as bricks, blocks (cinder or cement), and the like. Masonry elements are laid course by course on an appropriate foundation, in one of many standard configurations wherein a course of grout or mortar lies between each row of masonry elements and between each adjacent masonry element. Open mortar joints often adhere poorly to the masonry elements and are relatively porous allowing some water seepage and penetration of the joint. Consequently, the weakest link in masonry construction are the mortar joints, which are a poor barrier to heat, cold and moisture with resulting deterioration of a wall.

The laying of masonry elements as described above requires a degree of skill because the masonry elements must be laid in an even manner and in reasonably straight lines to provide the aesthetic qualities of a well-designed structure such as a wall. In addition the mortar needs to be troweled onto the masonry elements so that there is not an excess of mortar built up between each horizontal and vertically adjacent masonry element, otherwise there is wastage of materials and the aesthetic appeal of the masonry elements may be compromised. Such a process is both time-consuming and costly. Several solutions to these issues have been described.

Pearlman, U.S. Pat. No. 4,075,808 discloses a masonry element ("wall unit") having vertically and horizontally offset front and rear faces which form a tongue and groove interlocking means. The masonry elements also have bed-to-bed face passages and header-to-header channels to allow mortar to be poured into the masonry element to rigidly hold the masonry element in place. The specification also discloses corner, end and interior masonry elements. It is important to note that Pearlman's '808 disclosure places no special importance on the outward appearance of the front face of a structure made with Pearlman's masonry elements. Moreover, Pearlman's masonry elements in the '808 disclosure are blocks rather than bricks, where it is common for adjacent masonry elements to have almost no mortar showing.

Storer-Folt, U.S. Pat. No. 5,802,797 discloses a masonry system in which specially shaped bricks are dry-stacked and subsequently bonded by pouring mortar or grout into apertures in the bricks. The bricks have alignment projections extending from the bottom bed faces which register with alignment grooves in the top bed faces of the lower bricks to align the upper bricks before bonding. The projections and grooves define a recess to admit mortar between adjacent brick faces. The bricks also have recesses in the header faces to admit mortar between adjacent header faces. The front faces of the bricks are contoured to create the appearance of mortar joints when the bricks are stacked. It is important to note that the masonry system of Storer-Folt's '797 disclosure only provides for direct interlocking in a bottom face to a top face mode.

For the foregoing reasons, there is a need to provide novel interlocking masonry articles and improved construction methods to readily form continuous wall sections with mortar-less joints that have the appearance of mortared joints. The inventor of this application has discovered improved masonry articles where interlocking of the masonry articles occurs in a top face to bottom face mode, as well as providing for tongue and groove interlocking in adjacent masonry articles. Moreover, in this inventor's improved masonry articles, the outward appearance of the front face of a structure made with these masonry articles conforms to a brick and mortar or block and mortar configuration. This inventor's improved masonry articles provide for simple and efficient assembly including the ability to adjust side-by-side placement of masonry articles to correct length mismatches while laying a structure.

SUMMARY OF THE INVENTION

Accordingly, it is an object of this disclosure to provide a plurality of interlocking masonry articles.

It is a further object of this disclosure to provide a plurality of improved interlocking masonry articles that interlock in a top to bottom face mode as well as in an adjacent side by side mode so that an outward face of a structure made with the masonry articles have a mortar-like gap located between each one of the plurality of masonry articles.

It is yet a still further object of this disclosure to provide methods for assembling structures using the plurality of improved interlocking masonry articles.

It is a further object of this disclosure to provide methods for making the plurality of improved interlocking masonry articles.

PREFERRED EMBODIMENTS OF THE INVENTION

In accordance with one embodiment of this invention a plurality of masonry articles is disclosed, the plurality of masonry articles comprising, in combination a first header and a second header for each of the plurality of masonry articles, a contoured portion of the first header of each of the plurality of masonry articles for coupling to a contoured portion of another second header of another one of the plurality of masonry articles, and a contoured portion of the second header of each one of the plurality of masonry articles for coupling to a contoured portion of one other first header of one other of the plurality of masonry articles so that an outward face of a portion of a wall assembled with the plurality of masonry articles has a mortar-like vertically oriented gap; the plurality of masonry articles when assembled to provide a portion of the wall having a contoured front face, the plurality of masonry articles when assembled to provide a portion of the wall having a lower base and a contoured upper base of each of the plurality of masonry articles configured for coupling a portion of the contoured upper base of each of the plurality of masonry articles to a portion of a lower base of one of the other plurality of masonry articles so that the outward face of the portion of the wall assembled with all of the plurality of masonry articles has a mortar-like horizontally oriented gap.

In accordance with a second embodiment of this invention, a collection of interlocking masonry articles is disclosed, the collection of interlocking masonry articles comprising, in combination a plurality of masonry articles also comprising a plurality of corner masonry articles and a plurality of alternative corner masonry articles, the plurality of masonry articles, the plurality of corner masonry articles and the plurality of alternative corner masonry articles together providing contoured shapes so that an outward face of a portion of a wall assembled with the plurality of masonry articles, the plurality of corner masonry articles and the plurality of alternative corner masonry articles provide the appearance of a plurality of mortar-like horizontally oriented and mortar-like vertically oriented gaps.

In accordance with a third embodiment of this invention, a method for assembling a portion of a wall with a plurality of masonry articles comprises the steps of providing a first header and a second header for each of the plurality of masonry articles, a contoured portion of the first header of each of the plurality of masonry articles for coupling to a contoured portion of another second header of another one of the plurality of masonry articles, and a contoured portion of the second header of each one of the plurality of masonry articles for coupling to a contoured portion of one other first header of one other of the plurality of masonry articles so that an outward face of a portion of a wall assembled with the plurality of masonry articles has a mortar-like vertically oriented gap; and providing the plurality of masonry articles when assembled to provide a portion of the wall having a contoured front face, the plurality of masonry articles when assembled to provide a portion of the wall having a lower base and a contoured upper base of each of the plurality of masonry articles configured for coupling a portion of the contoured upper base of each of the plurality of masonry articles to a portion of a lower base of one of the other plurality of masonry articles so that the outward face of the portion of the wall assembled with all of the plurality of masonry articles has a mortar-like horizontally oriented gap.

The foregoing and other objects, features, and advantages of the invention will be apparent from the following, more detailed description of the preferred embodiments of the invention, as illustrated in the accompanying drawings.

DESCRIPTION OF THE INVENTION

In this application the term masonry articles refers to any suitable masonry unit including bricks, clay or concrete blocks that are shaped in the preferred configurations of this disclosure.

Figure 1:
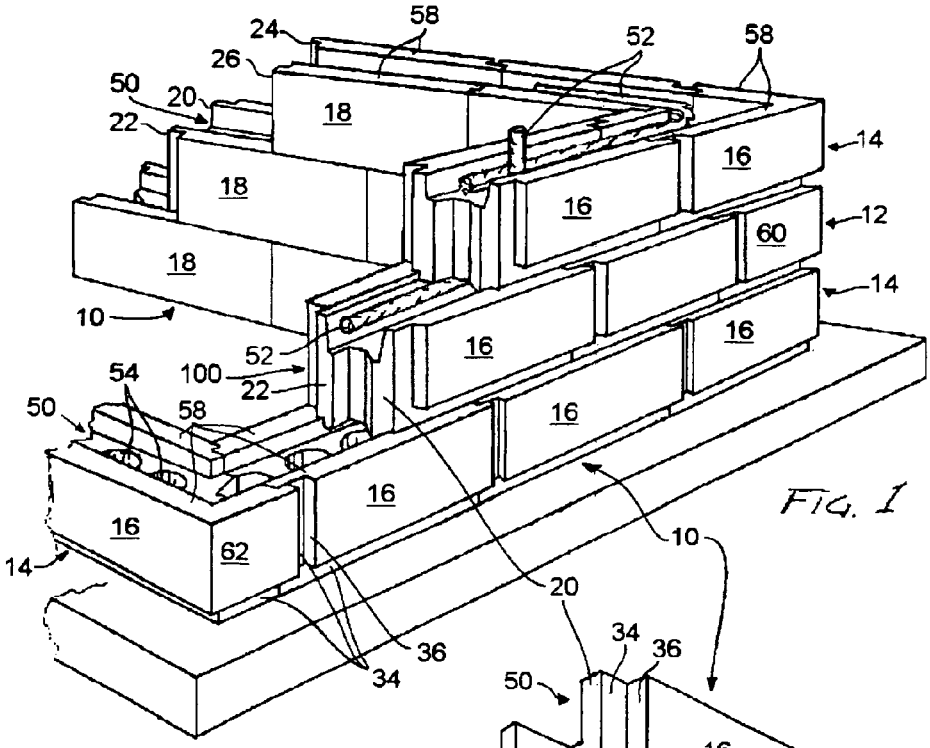
FIG. 1 is a perspective view of a foundation supporting a portion of a wall structure made with a plurality of reinforcing rods disposed through a plurality of interlocking masonry articles according to the present invention.
Figure 3:
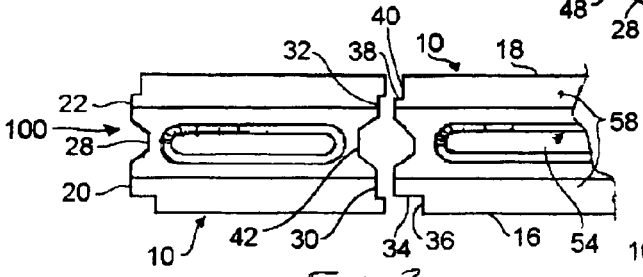
FIG. 3 is a top plan view of a pair of horizontally interlocking adjacent alternative masonry articles of the type shown in FIG. 2.
Figure 2:
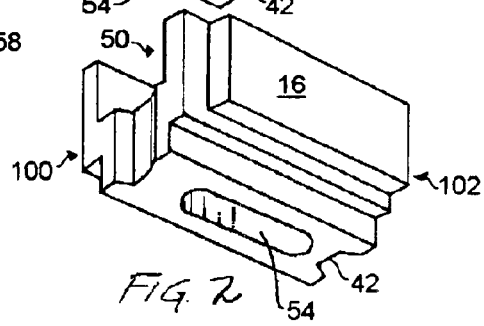
FIG. 2 is a perspective view of a pair of alternative masonry articles aligned to interlock vertically staggered as shown in the portion of the wall structure of FIG. 1.

According to FIGS. 1, 2 and 3, each of a plurality of masonry articles 10 substantially comprises a parallelepiped having a first header 100 located at a first end of the plurality of masonry articles 10, a second header 102 located at a second end of the plurality of masonry articles 10, a front face 16, a back face 18, a lower base 56 and an upper base 58. The front face 16 of each of the plurality of masonry articles 10 is contoured. A contoured portion of the second header 102 of each of the plurality of masonry articles 10 couples to a contoured portion of one other first header 100 of one other of the plurality of masonry articles 10, and a contoured portion of the first header 100 of each of the plurality of masonry articles 10 couples to a contoured portion of one other second header 102 of one other of the plurality of masonry articles 10 so that an outward face of a portion of a wall assembled with the plurality of masonry articles 10 on a foundation has a plurality of mortar-like vertically oriented gaps, each one of the plurality of mortar-like vertically oriented gaps located adjacently between each one of the plurality of masonry articles 10. Furthermore, a portion of the lower base 56 of each of the plurality of masonry articles 10 couples to a portion of the contoured upper base 58 of one other of the plurality of masonry articles 10 so that the outward face of the portion of the wall assembled with the plurality of masonry articles 10 has a plurality of mortar-like horizontally oriented gaps, each one of the plurality of mortar-like horizontally oriented gaps located adjacently between each of one of the plurality of masonry articles 10.

The back face 18 of each of the plurality of masonry articles 10 is substantially parallel to the front face 16 of each of the plurality of masonry articles 10. According to FIG. 1, the back face of a portion of the wall assembled with the plurality of masonry articles 10 has no plurality of mortar-like gaps located adjacently between each of the plurality of masonry articles 10. It is understood that the back face 18 of each of the plurality of masonry articles 10 may be contoured without changing the functionality of each of the plurality of masonry articles 10 so that the back face of the portion of the wall may have the appearance of the plurality of mortar-like vertically oriented gaps and the plurality of mortar-like horizontally oriented gaps, each of the plurality of mortar-like vertically oriented gaps and the plurality of mortar-like horizontally oriented gaps located adjacently between each of the plurality of masonry articles 10.

The first header 100 of the plurality of masonry articles 10 comprises a first projecting portion 20, a second projecting portion 22 and an end-recessed portion 28. The end-recessed portion 28 is located between the first projecting portion 20 and the second projecting portion 22 of the first header 100 of each of the plurality of masonry articles 10. The second header 102 of the plurality of masonry articles 10 comprises a first opposite projecting portion 24 adjacent to a first inner recessed portion 30 of the second header 102 of each of the plurality of masonry articles 10, a second opposite projecting portion 26 adjacent to a second inner recessed portion 32 of the second header 102 of each of the plurality of masonry articles 10 and an opposite recessed portion 42. The opposite recessed portion 42 is located between the first inner recessed portion 30 and the second inner recessed portion 32 of the second header 102 of each of the plurality of masonry articles 10.

An elevated portion of the front face 16 of each of the plurality of masonry articles 10 comprises a vertically oriented edge 36 of the elevated portion of the front face 16 and a horizontally oriented edge 44 of the elevated portion of the front face 16. The elevated portion of the front face 16 of each of the plurality of masonry articles 10 is adjacent to an indented portion 34 of the surface of the front face 16. The indented portion 34 of the front face 16, bounded by the vertically oriented edge 36 and by the horizontally oriented edge 44, extends from an end of the first projecting portion 20 of the first header 100 of each of the plurality of masonry articles 10 to the vertically oriented edge 36 of the elevated portion of the front face 16, and from the end of the first projecting portion 20 of the first header 100 of each of the plurality of masonry articles 10 to an end of the first opposite projecting portion 24 of the second header 102 of each of the plurality of masonry articles 10. The indented portion 34 of the surface of the front face 16 is substantially parallel to the surface of the elevated portion of the front face 16. A lower portion of the indented portion 34 of the surface of the front face 16 comprises a substantially L-shaped step 46 extending from the end of the first projecting portion 20 of the first header 100 of each of the plurality of masonry articles 10 to the end of the first opposite projecting portion 24 of the second header 102 of each of the plurality of masonry articles 10.

Similarly, the back face 18 of each of the plurality of masonry articles 10 comprises an opposite edge 40 substantially perpendicular to an opposite indented portion 38 of the surface of the back face 18. The opposite indented portion 38 of the surface of the back face 18 is located between an end of the second projecting portion 22 of the first header 100 of each of the plurality of masonry articles 10 and the opposite edge 40 of the back face 18. The opposite indented portion 38 of the surface of the back face 18 is substantially parallel to the surface of the back face 18. A lower portion of the back face 18 extending from the end of the second projecting portion 22 of the first header 100 of each of the plurality of masonry articles 10 to an end of the second opposite projecting portion 26 of the second header 102 of each of the plurality of masonry articles 10 comprises a substantially opposite L-shaped step 48. The opposite L-shaped step 48 of the back face 18 and the L-shaped step 46 of the front face 16 have substantially the same height, so that the portion of the lower base 56 of each of the plurality of masonry articles 10 may couple to the portion of the contoured upper base 58 of one other of the plurality of masonry articles 10. The portion of the contoured upper base 58 of each of the plurality of masonry articles 10 comprises a channel 50 extending substantially horizontally from the first header 100 of each of the plurality of masonry articles 10 to the second header 102 of each of the plurality of masonry articles 10. When the portion of the contoured upper base 58 of one other of the plurality of masonry articles 10 is coupled to the portion of the lower base 56 of the plurality of masonry articles the channel 50 of the portion of the contoured upper base 58 provides an opening, which may accommodate a substantially horizontally oriented reinforcing rod 52. The plurality of masonry articles 10 have a plurality of holes 54 extending from the upper base 58 of each of the plurality of masonry articles 10 to the lower base 56 of each of the plurality of masonry articles 10. According to FIGS. 1, 2 and 3 the plurality of holes 54 may be substantially circular in shape or substantially elongated in shape. Each of the plurality of holes 54 may accommodate a substantially vertically oriented reinforcing rod 52 within each of the plurality of holes 54. Typically during assembly of the wall, a course of the plurality of masonry articles is off set horizontally relative to one other course of one other of the plurality of masonry articles to provide a decorative appearance for the outward face of the wall. During assembly of the wall the course of the plurality of masonry articles 10 is aligned vertically with one other course of the other plurality of masonry articles 10 so that the plurality of holes 54 of each of the plurality of masonry articles 10 is substantially aligned to permit each of a plurality of substantially vertically oriented reinforcing rods 52 to pass through the course of the plurality of masonry articles 10 vertically aligned to one other course of one other of the plurality of masonry articles 10. The alignment of the plurality of masonry articles 10 also permits mortar to be poured into the plurality of holes 54 so that the course of the plurality of masonry articles 10 may be permanently vertically and horizontally coupled to one other course of one of the other plurality of masonry articles 10 when the mortar sets. The mortar substantially fills the opening located between the channel 50 of the portion of the contoured upper base 58 of one other of the plurality of masonry articles 10 and the portion of the lower base 56 of one of the plurality of masonry articles 10. The mortar also adheres to the course of the lower base 56 of one of the plurality of masonry articles 10, which is vertically coupled to the other adjacent course of the portion of the contoured upper base 58 of one other of the plurality of masonry articles 10.

The first header 100 of each of the plurality of masonry articles 10 provides a tongue portion for coupling to a groove portion of the second header 102 of each of the plurality of masonry articles 10. The indented portion 34 of the surface of the front face 16 is of greater width then the opposite indented portion 38 of the surface of the back face 18. The width of the first opposite projecting portion 24 of the second header 102 of each of the plurality of masonry articles 10 and the width of the second opposite projecting portion 26 of the second header 102 of each of the plurality of masonry articles 10 are substantially the same as the width of the opposite indented portion 38 of the surface of the back face 18 of the first header 100 of each of the plurality of masonry articles 10. When each of the plurality of masonry articles 10 couples adjacently to one other of the plurality of masonry articles 10, the indented portion 34 of the front face 16 of the plurality of masonry articles 10 provides a vertical mortar-like gap because of the difference in width of the indented portion 34 of the surface of the front face 16 and the opposite indented portion 38 of the surface of the back face 18 of the first header 100 of each of the plurality of masonry articles 10. A significant advantage of this method of assembly of the portion of the wall is that the distance between each of the plurality of masonry articles 10 adjacently coupled to one other of the plurality of masonry articles 10 may be selectively adjusted to accommodate variations in the length of each course of the plurality of masonry articles 10 of the portion of the wall. Additionally, when each course of the plurality of masonry articles 10 vertically couples to one other of the other adjacent course of the plurality of masonry articles 10, the horizontally oriented edge 44 of the elevated portion of the front face 16 of each course of the plurality of masonry articles 10 provides a plurality of horizontal mortar-like gaps because of the contoured shape of the front face 16 of each of the plurality of masonry articles 10 as described above.

In addition to the plurality of masonry articles 10, a plurality of corner masonry articles 12 (see FIGS. 1, 4 and 6) permit assembly of a portion of a corner section of the wall (see FIG. 1) and a plurality of alternative corner masonry articles 14 (see FIGS. 1 and 4A) permit assembly of a portion of an alternative corner section of the wall (see FIG. 1). The plurality of corner masonry articles 12 and the plurality of alternative corner masonry articles 14 permit corner directionality for assembly of the wall.

Figure 4:
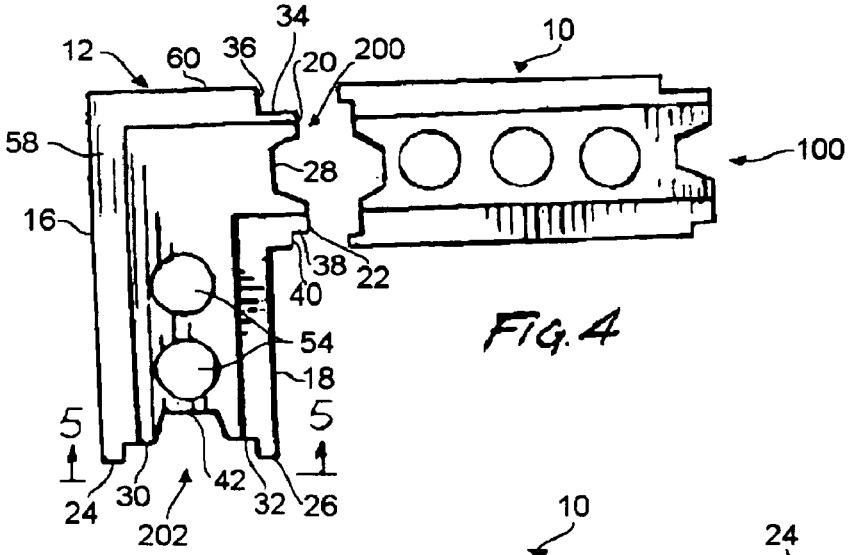
FIG. 4 is a top plan view of a corner masonry article horizontally interlocking to an adjacent masonry article as shown in the portion of the wall structure of FIG. 1.
Figure 6:
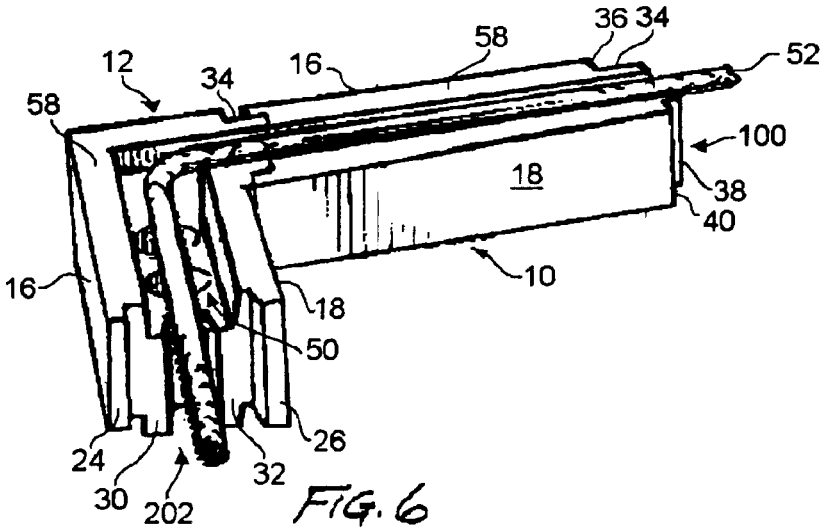
FIG. 6 is a perspective view of the corner masonry article horizontally interlocking to the masonry article of FIG. 4 with an angular shaped reinforcing rod disposed in a channel defined by a portion of the corner masonry article and a portion of the masonry article according to the present invention.

According to FIGS. 1, 4 and 6, each of the plurality of corner masonry articles 12 substantially comprises a parallelepiped having a first corner header 200, a second corner header 202 located at a second end, a front face 16, a back face 18, a corner end 60 located at a first end opposite the corner second header 202, a lower base 56 and an upper base 58. The front face 16 of each of the plurality of corner masonry articles 12 is contoured similarly to the contoured front face 16 of each of the plurality of masonry articles 10 (see description above). A contoured portion of the first corner header 200 of each of the plurality of corner masonry articles 12 couples to the contoured portion of the second header 102 of one of the plurality of masonry articles 10, and a contoured portion of the second corner header 202 of each of the plurality of corner masonry articles 12 couples to the contoured portion of one other first header 100 of one other of the plurality of masonry articles 10 so that an outward face of the portion of the corner section of the wall has plurality of mortar-like vertically oriented gaps, the plurality of the mortar-like vertically oriented gaps located adjacently between the portion of the second header 102 of one of the plurality of masonry articles 10 and the portion of the first corner header 200 of one of the plurality of corner masonry articles 12, and the plurality of the mortar-like vertically oriented gaps also located between the portion of one other first header 100 of one other of the plurality of masonry articles 10 and the portion of the second corner header 202 of one of the plurality of corner masonry articles 12. Furthermore, a portion of the lower base 56 of one of the plurality of corner masonry articles 12 couples to a portion of a contoured upper base 58 of a combination of one of the plurality of alternative corner masonry articles 14 coupled to one of the plurality of masonry articles 10 so that the outward face of the portion of the corner section of the wall assembled with the plurality of corner masonry articles 12 has a plurality of mortar-like horizontally oriented gaps, the mortar-like horizontally oriented gaps located adjacently between each one of the plurality of masonry articles 12 vertically coupled to the combination of one of the plurality of alternative corner masonry articles 14 coupled to one of the plurality of masonry articles 10.

The back face 18 of each of the plurality of corner masonry articles 12 is substantially parallel to the front face 16 of each of the plurality of corner masonry articles 12. According to FIGS. 4 and 6, the portion of the corner section of the back face of the wall assembled from the plurality of corner masonry articles 12 has no plurality of mortar-like gaps located adjacently between the plurality of corner masonry articles 12 and the combination of one of the plurality of masonry articles 10 and one of the alternative corner masonry articles 14. It is understood that the back face 18 of each of the plurality of corner masonry articles 12 may be contoured without changing the functionality of each of the plurality of corner masonry articles 12 so that the back face of the portion of the corner section of the wall may have the appearance of the plurality of mortar-like vertically oriented gaps, each of the plurality of mortar-like vertically oriented gaps located adjacently between one of the plurality of corner masonry articles 12 coupled to one of the plurality of corner articles 12, and one of the plurality of corner masonry articles 12 coupled to one other of the plurality of masonry articles 10. In addition, the back face 18 of each of the plurality of corner masonry articles 12 may be contoured without changing the functionality of each of the plurality of corner masonry articles 12 so that the back face of the portion of the corner section of the wall may have the appearance of the plurality of mortar-like horizontally oriented gaps, each one of the plurality of mortar-like horizontally oriented gaps located adjacently between each of the plurality of corner masonry articles 12 vertically coupled to the combination of one of the plurality of alternative corner masonry articles 14 coupled to one of the masonry articles 10.

The first corner header 200 of the plurality of corner masonry articles 12 comprises a first projecting portion 20, a second projecting portion 22 and an end-recessed portion 28. The end-recessed portion 28 is located between the first projecting portion 20 and the second projecting portion 22 of the first corner header 200 of each of the plurality of corner masonry articles 12. The first corner header 200 of each of the plurality of corner masonry articles 12 projects substantially perpendicularly from a portion of the back face 18 of each of the plurality of corner masonry articles 12. A front-end face of the corner end 60 of the plurality of corner masonry articles 12 is contoured similarly to the front face 16 of each of the plurality of corner masonry articles 12 (see description above and FIGS. 1 and 2). The corner end 60 of each of the plurality of corner masonry articles 12 is opposite to the second corner header 202 of each of the plurality of corner masonry articles 12. The second corner header 202 of the plurality of corner masonry articles 12 is similar to the second header 102 of the plurality of masonry articles 10 (see above). The second corner header 202 of the plurality of corner masonry articles 12 comprises a first opposite projecting portion 24 adjacent to a first inner recessed portion 30 of the second corner header 202 of each of the plurality of corner masonry articles 12, a second opposite projecting portion 26 adjacent to a second inner recessed portion 32 of the second corner header 202 of each of the plurality of corner masonry articles 12 and an opposite recessed portion 42. The opposite recessed portion 42 is located between the first inner recessed portion 30 and the second inner recessed portion 32 of the second corner header 202 of each of the plurality of corner masonry articles 12.

Figure 5:
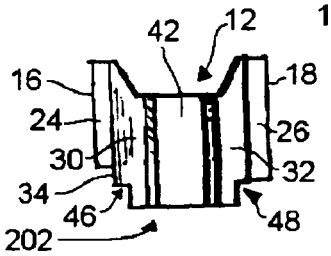
FIG. 5 is a sectional view along 5—5 of an end elevation portion of the corner block of FIG. 4.

An elevated portion of the front-end face of the corner end 60 of each of the plurality of corner masonry articles 12 comprises a vertically oriented edge 36 of the elevated portion of the front-end face and a horizontally oriented edge 44 of the elevated portion of the front-end face of the corner end 60 (see FIG. 5, which shows an elevation view of the front face 16 of the second header 202 and is substantially similar to the front-end face of the corner end 60). The elevated portion of the front-end face of the corner end 60 of each of the plurality of corner masonry articles 12 is adjacent to an indented portion 34 of the surface of the front-end face of the corner end 60. The indented portion 34 of the front-end face of the corner end 60 bounded by the vertically oriented edge 36 and by the horizontally oriented edge 44, extends from the first corner header 200 of each of the plurality of corner masonry articles 12 to the front face 16 of each of the plurality of corner masonry articles 12. The front face 16 of each of the plurality of corner masonry articles 12 comprises an elevated portion. The indented portion 34 of the front face 16 bounded by the horizontally oriented edge 44 extends from the corner end 60 to the second corner header 202 of each of the plurality of corner masonry articles 12. The indented portion 34 of the surface of the front-end face of the corner end 60 is substantially parallel to the surface of the elevated portion of the front-end face of the corner end 60. The indented portion 34 of the surface of the front face of the front face 16 is substantially parallel to the surface of the elevated portion of the front face 16. A lower portion of the indented portion 34 of the surface of the front-end face of the corner end 60 comprises a substantially L-shaped step 46 extending from the first corner header 200 of each of the plurality of corner masonry articles 12 to the front face 16 of each of the plurality of corner masonry articles 12. A lower portion of the indented portion 34 of the front face 16 also comprises a substantially L-shaped step 46 extending from the corner end 60 of each of the plurality of corner masonry articles 12 to the second corner header 202 of each of the plurality of corner masonry articles 12.

Similarly, a back end face of the corner end 60 of each of the plurality of corner masonry articles 12 comprises an opposite edge 40 substantially perpendicular to an opposite indented portion 38 of the surface of the back end face of the corner end 60 of the plurality of corner masonry articles 12. The opposite indented portion 38 of the surface of the back end face of the corner end 60 is located between an end of the second projecting portion 22 of the first corner header 200 of each of the plurality of corner masonry articles 12 and the opposite edge 40 of the back end face of the corner end 60 of each of the plurality of corner masonry articles 12. The opposite indented portion 38 of the surface of the back end face of the corner end 60 of each of the plurality of corner masonry articles 12 is substantially parallel to the surface of the back end face of the corner end 60 of each of the plurality of corner masonry articles 12. A lower portion of the back end face of the corner end 60 of each of the plurality of corner masonry articles 12 comprises a substantially opposite L-shaped step 48. The substantially opposite L-shaped step 48 of the lower portion of the back end face of the corner end 60 extends from the end of the second projecting portion 22 of the first header 102 of each of the plurality of corner masonry articles 12 to the back face 18 of each of the plurality of corner masonry articles 12. A lower portion of the back face 18 of each of the plurality of corner masonry articles 12 also comprises the substantially opposite L-shaped step 48. The opposite L-shaped step 48 of the back face 18 of each of the plurality of corner masonry articles 12 extends from the back end face of the corner end 60 to the second corner header 202 of each of the plurality of corner masonry articles 12 (see FIGS. 5 and 6). The opposite L-shaped step 48 of the back end face of the corner end 60 of each of the plurality of corner masonry articles 12, the L-shaped step 48 of the back face 18, the L-shaped step 46 of the front-end face of the corner end 60 and the L-shaped step 46 of the front face 16 have substantially the same height, so that the portion of the lower base 56 of each of the plurality of corner masonry articles 12 may couple to the portion of the contoured upper base 58 of a combination of one of the plurality of alternative corner masonry articles 14 coupled to one of the plurality of masonry articles 10 in the portion of the corner section of the wall. The portion of the contoured upper base 58 of each of the plurality of corner masonry articles 12 comprises a channel 50 extending substantially horizontally from the first corner header 200 of each of the plurality of corner masonry articles 12 to the second corner header 202 of each of the plurality of corner masonry articles 12. When the contoured upper base 58 of each of the plurality of corner masonry articles 12 vertically couples to a lower base 56 of a combination of one of the vertically adjacent plurality of alternative corner masonry articles 14 coupled to the one of the plurality of masonry articles 10 the channel 50 provides an opening, which may accommodate an angularly shaped reinforcing rod 52. The plurality of corner masonry articles 12 have a plurality of holes 54 extending from the upper base 58 of each of the plurality of corner masonry articles 12 to the lower base 56 of each of the plurality of corner masonry articles 12. Each of the plurality of holes 54 may accommodate the substantially vertically oriented reinforcing rod 52 within each of the plurality of holes 54. During assembly of the portion of the corner section of the wall each course of the plurality of corner masonry articles 12 is aligned vertically with each course of the combination of one of the plurality of masonry articles 10 coupled to one of the plurality of alternative corner masonry articles 14 so that the plurality of holes 54 of each of the plurality of alternative corner masonry articles 14 is substantially aligned to permit the substantially vertically oriented reinforcing rod 52 to pass through each course of the plurality of corner masonry articles 12 vertically aligned to each course of the combination of one of the plurality of masonry articles 10 coupled to one of the plurality of alternative corner masonry articles 14. The alignment of the plurality of corner masonry articles 12 also permits mortar to be poured into the plurality of holes 54 so that each course of the combination of one of the plurality of masonry articles 10 coupled to one of the plurality of alternative corner masonry articles 14 may be permanently vertically and horizontally coupled to each course of the plurality of corner masonry articles 12 when the mortar sets. The mortar substantially fills the opening located between the channel 50 of the portion of the contoured upper base 58 of each of the plurality of corner masonry articles 12 and the portion of the lower base 56 of the combination of one of the plurality of masonry articles 10 horizontally coupled to one of the plurality of alternative corner masonry articles 14. The mortar also adheres to each course of the portion of the lower base 56 of the combination of one of the plurality of masonry articles 10 coupled to one of the plurality of alternative corner masonry articles 14, which is vertically coupled to the adjacent course of the portion of the contoured upper base 58 of each of the plurality of corner masonry articles 12.

The first corner header 200 of each of the plurality of corner masonry articles 12 provides a tongue portion for coupling to a groove portion of the second header 102 of each of the plurality of masonry articles 10 (see FIG.4). The indented portion 34 of the surface of the front-end face of the corner end 60 of the plurality of corner masonry articles 12 is of greater width then the opposite indented portion 38 of the surface of the back end face of the corner end 60 of the plurality of corner masonry articles 12. The width of the opposite indented portion 38 of the surface of the back end face of the corner end 60 of each of the plurality of corner masonry articles 12 is substantially the same as the width of the first opposite projecting portion 24 of the second header 102 of each of the plurality of masonry articles 10 and the width of the second opposite projecting portion 26 of the second header 102 of each of the plurality of masonry articles 10. When each of the plurality of corner masonry articles 12 couples adjacently to the plurality of masonry articles 10 the indented portion 34 of the front-end face of the corner end 60 of each of the plurality of corner masonry articles 12 and the second header 102 of one of the plurality of masonry articles 10 provides a vertical mortar-like gap because of the difference in width of the indented portion 34 of the surface of the front-end face of the corner end 60 and the opposite indented portion 38 of the surface of the back end face of the corner end 60 of each of the plurality of corner masonry articles 12. Additionally, when each course of the plurality of corner masonry articles 12 couples vertically to each course of the combination of one of the plurality of alternative corner masonry articles 14 coupled to one of the plurality of masonry articles 10, the horizontally oriented edge 44 of the elevated portion of front-end face of the corner end 60 of each course of the plurality of corner masonry articles 12 provides a horizontal mortar-like gap because of the contoured shape of the front-end face of the corner end 60 of each of the plurality of masonry articles 12 as described above.

Figure 4A:
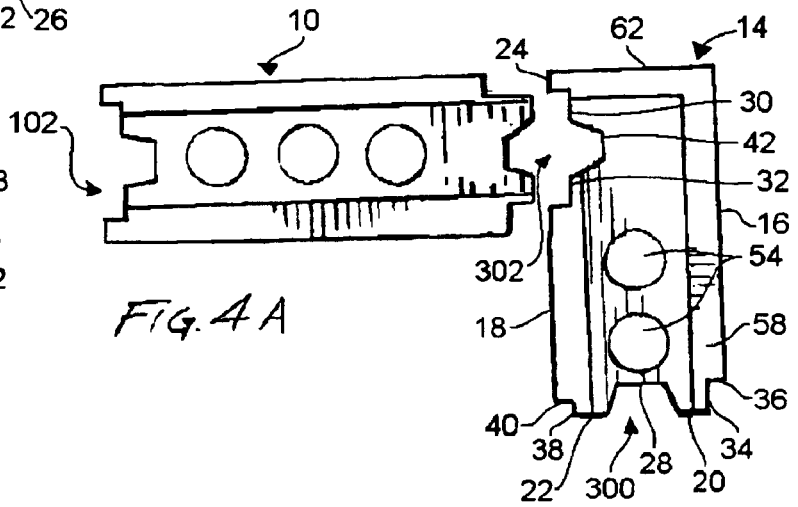
FIG. 4A is a top plan view of an alternative corner masonry article horizontally interlocking to an adjacent masonry article as shown in the portion of the wall structure of FIG. 1.

According to FIGS. 1 and 4A each of a plurality of alternative corner masonry articles 14 substantially comprises a parallelepiped having a first alternative corner header 300 located at a first end, a second alternative corner header 302, a front face 16, a back face 18, an alternative corner end 62 located at a second end opposite the first alternative corner header 300, the lower base 56 and the upper base 58. The front face 16 of each of the plurality of alternative corner masonry articles 14 is contoured similarly to the contoured front face 16 of each of the plurality of masonry articles 10 (see description above). A contoured portion of the first alternative corner header 300 of each of the plurality of alternative corner masonry articles 14 couples to the contoured portion of the second header 102 of one of the plurality of masonry articles 10 and a contoured portion of the second alternative corner header 302 of each of the plurality of alternative corner masonry articles 14 couples to the contoured portion of one other first header 100 of one of the other plurality of masonry articles 10 so that an outward face of the portion of the alternative corner section of the wall has plurality of mortar-like vertically oriented gaps, the plurality of the mortar-like vertically oriented gaps located adjacently between the portion of the first alternative corner header 300 of each of the plurality of alternative corner masonry articles 14 and the portion of the second header 102 of one of the plurality of masonry articles 10, and the plurality of the mortar-like vertically oriented gaps also located between the portion of the second alternative corner header 302 of one of the plurality of alternative corner masonry articles 14 and the portion of one other first header 100 of one of the other plurality of masonry articles 10. Furthermore, a portion of the lower base 56 of each of the plurality of alternative corner masonry articles 14 couples to a portion of the contoured upper base 58 of each of a combination of one of the plurality of corner masonry articles 12 coupled to one of the plurality of masonry articles 10 so that the outward face of the portion of the alternative corner section of the wall assembled with the plurality of alternative corner masonry articles 14 has a plurality of mortar-like horizontally oriented gaps, each one of the plurality of mortar-like horizontally oriented gaps located adjacently between each of the plurality of alternative corner masonry articles 14 and each of the combination of one of the plurality of masonry articles 12 coupled to one of the plurality of masonry articles 10.

The back face 18 of each of the plurality of alternative corner masonry articles 14 is substantially parallel to the front face 16 of each of the plurality of alternative corner masonry articles 14. According to FIG. 4A, the back face of the portion of the alternative corner section of the wall assembled from the plurality of alternative corner masonry articles 14 has no plurality of mortar-like vertically oriented gaps, located adjacently between the combination of the plurality of one of the alternative corner masonry articles 14, one of the plurality of masonry articles 10 and one other of the plurality of masonry articles 10. It is understood that the back face 18 of each of the plurality of alternative masonry articles 14 may be contoured without changing the functionality of each of the plurality of alternative masonry articles 14 so that the back face of the portion of the alternative corner section of the wall may have the appearance of the plurality of mortar-like vertically oriented gaps, the plurality of mortar-like vertically oriented gaps located adjacently between one of the plurality of the alternative corner masonry articles 14 coupled to one of the plurality of masonry articles 10 and one of the plurality of the alternative corner masonry articles 14 coupled to one other of the plurality of masonry articles 10. In addition, the back face 18 of each of the plurality of corner masonry articles 14 may be contoured without changing the functionality of each of the plurality of corner masonry articles 14 so that the back face of the portion of the alternative corner section of the wall may have the appearance of the plurality of the mortar-like horizontally oriented gaps, each of the mortar-like horizontally oriented gaps located adjacently between each of the plurality of alternative corner masonry articles 14 vertically coupled to the combination of one of the plurality of the corner masonry articles 12 coupled to one of the plurality of masonry articles 10.

The first alternative corner header 300 of the plurality of alternative corner masonry articles 14 is similar to the first header 100 of the plurality of masonry articles 10 (see above). The first alternative corner header 300 of the plurality of alternative corner masonry articles 14 is located at a first end of each of the plurality of alternate corner masonry articles 14. The alternative corner end 62 of each of the plurality of alternative masonry articles 14 is opposite to the first header 300 of each of the plurality of alternative masonry articles 14. The first alternative corner header 300 of the plurality of alternative corner masonry articles 14 comprises a first projecting portion 20, a second projecting portion 22 and an end-recessed portion 28. The end-recessed portion 28 is located between the first projecting portion 20 and the second projecting portion 22 of the first alternative corner header 300 of each of the plurality of alternative corner masonry articles 14. A front-end face of the alternative corner end 62 of the plurality of alternative corner masonry articles 14 is contoured similarly to the front face 16 of each of the plurality of corner masonry articles 14 (see above). The second alternative corner header 302 of the plurality of alternative corner masonry articles 14 comprises a first opposite projecting portion 24 adjacent to a first inner recessed portion 30 of the second alternative corner header 302 of each of the plurality of alternative corner masonry articles 14. A portion of the first opposite projecting portion 24 of each of the plurality of alternative corner masonry articles 14 is substantially parallel to the back face 18 of each of the plurality of alternative corner masonry articles 14. The second alternative corner header 302 of the plurality of alternative corner masonry articles 14 further comprises a second inner recessed portion 32 and an opposite recessed portion 42. The second inner recessed portion 32 of each of the plurality of alternative corner masonry articles 14 is adjacent to the front face 16 of each of the plurality of alternative corner masonry articles 14. The opposite recessed portion 42 is located between the first inner recessed portion 30 and the second inner recessed portion 32 of the second alternative corner header 302 of each of the plurality of alternative corner masonry articles 14. The second alternative corner header 302 of the plurality of alternative corner masonry articles 14 is located on a portion of the back face 18 of each of the plurality of alternate corner masonry articles 14.

An elevated portion of the front face 16 of each of the plurality of alternative masonry articles 14 comprises a vertically oriented edge 36 of the elevated portion of the front face 16 and a horizontally oriented edge 44 of the elevated portion of the front face 16. The front-end face of the alternative corner end 62 has an elevated portion and the horizontally oriented edge 44 of the front face 16 of the plurality of alternative masonry articles 14 also extends along the front-end face of the alternative corner end 62. The elevated portion of the front face 16 of each of the plurality of alternative corner masonry articles 14 is adjacent to an indented portion 34 of the surface of the front face 16. The indented portion 34 of the front face 16, bounded by the vertically oriented edge 36 and by the horizontally oriented edge 44, extends from an end of the first projecting portion 20 of the first alternative corner header 300 of each of the plurality of alternative corner masonry articles 14 to the vertically oriented edge 36 of the elevated portion of the front face 16, and from the end of the first projecting portion 20 of the first alternative corner header 300 of each of the plurality of alternative corner masonry articles 14 to the alternative corner end 62 of each of the plurality of alternative corner masonry articles 14 (see FIG. 1 in combination with FIG. 4A). The indented portion 34 of the surface of the front face 16 is substantially parallel to the surface of the elevated portion of the front face 16. A lower portion of the indented portion 34 of the surface of the front face 16 comprises a substantially L-shaped step 46 extending from the end of the first projecting portion 20 of the first alternative corner header 300 of each of the plurality of alternative corner masonry articles 14 to the alternative corner end 62 of each of the plurality of alternative corner masonry articles 14. The indented portion 34 of the front face 16 also extends along the surface of the front-end face of the alternative corner end 62 bounded by the horizontally oriented edge 44 of the elevated portion of the alternative corner end 62. A lower portion of the indented portion 34 of the front-end face of the alternative corner end 62 also comprises a substantially L-shaped step 46 extending from the front face 16 of each of the plurality of alternative corner masonry articles 14 to the second alternative corner header 302 of each of the plurality of alternative corner masonry articles 14.

Similarly, the back face 18 of each of the plurality of alternative corner masonry articles 14 comprises an opposite edge 40 substantially perpendicular to an opposite indented portion 38 of the surface of the back face 18 located between an end of the second projecting portion 22 of the first alternative corner header 300 of each of the plurality of alternative corner masonry articles 14 and the opposite edge 40 of the back face 18. The opposite indented portion 38 of the surface of the back face 18 is substantially parallel to the surface of the back face 18. A lower portion of the back face 18 of the plurality of alternative corner masonry articles 14 comprises a substantially opposite L-shaped step 48 extending from the end of the second projecting portion 22 of the first alternative corner header 300 of each of the plurality of alternative corner masonry articles 14 to an end of the second alternative corner header 302 of each of the plurality of alternative corner masonry articles 14. The opposite L-shaped step 48 of the back face 18, the L-shaped step 46 of the front face 16 and the L-shaped step of the front-end face of the alternative corner end 62 of the plurality of alternative corner masonry articles 14 have substantially the same height, so that the portion of the lower base 56 of each of the plurality of alternative corner masonry articles 14 may couple to the portion of the contoured upper base 58 of the combination of one of the plurality of corner masonry articles 12 coupled to one of the plurality of masonry articles 10 in the portion of the alternative corner section of the wall. The portion of the contoured upper base 58 of each of the plurality of alternative corner masonry articles 14 comprises a channel 50 extending substantially horizontally from the first alternative corner header 300 of each of the plurality of alternative corner masonry articles 14 to the second alternative corner header 302 of each of the plurality of alternative corner masonry articles 14. When the portion of the contoured upper base 58 of each of the plurality of alternative corner masonry articles 14 vertically couples to portion of the lower base 56 of the combination of one of the plurality of corner masonry articles 12 coupled to one of the plurality of masonry articles 10 the channel 50 provides an opening, which may accommodate the angular shaped reinforcing rod 52. The plurality of alternative corner masonry articles 14 have a plurality of holes 54 extending from the upper base 58 of each of the plurality of alternative corner masonry articles 14 to the lower base 56 of each of the plurality of alternative corner masonry articles 14. Each of the plurality of holes 54 may accommodate the substantially vertically oriented reinforcing rod 52 within each of the plurality of holes 54. During assembly of the portion of the alternative corner section of the wall each course of the plurality of alternative corner masonry articles 14 is aligned vertically with each course of the combination of one of the plurality of masonry articles 10 coupled to one of the plurality of corner masonry articles 12 so that the plurality of holes 54 of each of the plurality of alternative corner masonry articles 14 is substantially aligned to permit each of the plurality of substantially vertically oriented reinforcing rod 52 to pass through each course of the plurality of alternative corner masonry articles 14 vertically aligned to each course of the combination of one of the plurality of masonry articles 10 coupled to one of the plurality of corner masonry articles 12. The alignment of the plurality of alternative corner masonry articles 14 also permits mortar to be poured into the plurality of holes 54 so that each course of the combination of one of the plurality of masonry articles 10 coupled to one of the plurality of corner masonry articles 12 may be permanently vertically and horizontally coupled to each course of the plurality of alternative corner masonry articles 14 when the mortar sets. The mortar substantially fills the opening located between the channel 50 of the portion of the contoured upper base 58 of the plurality of alternative corner masonry articles 14 and the portion of the lower base 56 of the combination of one of the plurality of masonry articles 10 coupled to one of the plurality of corner masonry articles 12. The mortar also adheres to each course of the portion of the lower base 56 of the combination of one of the plurality of masonry articles 10 coupled to one of the plurality of corner masonry articles 12, which is vertically coupled to each adjacent course of the portion of the contoured upper base 58 of each of the plurality of alternative corner masonry articles 14.

The second alternative corner header 302 of each of the plurality of alternative corner masonry articles 14 provides a groove portion for coupling to a tongue portion of the first header 100 of each of the plurality of masonry articles 10 (see FIG. 4A). When the second alternative corner header 302 of each of the plurality of alternative corner masonry articles 14 couples adjacently to the first header 100 of one of the plurality of masonry articles 10 the indented portion 34 of the front face 16 of each of the plurality of masonry articles 10 provides a vertical mortar-like gap because of the difference in width of the indented portion 34 of the surface of the front face 16 and the opposite indented portion 38 of the surface of the back face 18 of the first header 100 of each of the plurality of masonry articles 10. Additionally, when each course of the plurality of alternative corner masonry articles 14 couples vertically to each course of the combination of one of the plurality of corner masonry articles 12 coupled to one of the plurality of masonry articles 10 the horizontally oriented edge 44 of the elevated portion of the front-end face of the alternative corner end 62 of each course of the plurality of alternative corner masonry articles 14 provides a horizontal mortar-like gap because of the contoured shape of the front-end face of the alternative corner end 62 of each of the plurality of alternative masonry articles 14 as described above.

While the invention has been particularly shown and described with reference to preferred embodiments thereof, it will be understood by those skilled in the art that the foregoing and other changes in form and details may be made therein without departing from the spirit and scope of the invention. For example, the front face of each of the plurality of masonry articles, the front face of each of the plurality of corner masonry articles and the front face of each of the plurality of alternative corner masonry articles may have various contoured shapes, so that the plurality of vertical oriented gaps and the plurality of horizontally oriented gaps may be at least tapered, squared, concave rounded and convex rounded, as well as having no gap. The plurality of masonry articles, the plurality of corner masonry articles and the plurality of alternative corner masonry articles may comprise various construction materials including colored concrete, composites and clays.

What is claimed is:

1. A plurality of masonry articles comprising, in combination:

a first header and a second header for each of said plurality of masonry articles, a contoured portion of said first header each of said plurality of masonry articles for coupling to a contoured portion of another second header of another one of said plurality of masonry articles, and a contoured portion of said second header of each one of said plurality of masonry articles for coupling to a contoured portion of one other first header of one other of said plurality of masonry articles so that an outward face of a portion of a wall assembled with said plurality of masonry articles has a mortar-like vertically oriented gap;

said first header of each of said plurality of masonry articles comprises a first projecting portion, a second projecting portion and an end-recessed portion of each of said plurality of masonry articles, said end-recessed portion located between said first projecting portion and said second projecting portion of said first header of each of said plurality of masonry articles;

said second header of each of said plurality of masonry articles comprises a first opposite projecting portion, a second opposite projecting portion, a first inner recessed portion, a second inner recessed portion and an opposite recessed portion of each of said plurality of masonry articles, said first opposite projecting portion adjacent to said first inner recessed portion of said second header of each of said plurality of masonry articles, said second opposite projecting portion adjacent to said second inner recessed portion of said second header of each of said plurality of masonry articles, said opposite recessed portion located between said first inner recessed portion and said second inner recessed portion of said second header of each of said plurality of masonry articles so that said first header of each of said plurality of masonry articles couples to one other second header of one other of said plurality of masonry articles and said second header of each of said plurality of masonry articles couples to said other first header of one other of said plurality of masonry articles to provide the portion of the wall; and said plurality of masonry articles when assembled to provide a portion of the wall having a contoured front face, said plurality of masonry articles when assembled to provide a portion of the wall having a lower base and a contoured upper base of each of said plurality of masonry articles configured for coupling a portion of said contoured upper base of each of said plurality of masonry articles to a portion of a lower base of one of the other plurality of masonry articles so that the outward face of the portion of the wall assembled with all of said plurality of masonry articles has a mortar-like horizontally oriented gap.

2. The plurality of masonry articles according to claim 1 further comprising a surface of said contoured front face of each of said plurality of masonry articles having an elevated portion and said elevated portion of the surface of said contoured front face adjacent to an indented portion of the surface of said contoured front face, said indented portion extending from an end of said first header to said elevated portion, so that the outward face of the portion of the wall assembled with said plurality of masonry articles provide the appearance of the mortar-like vertically oriented gap and the mortar-like horizontally oriented gap.

3. The plurality of masonry articles according to claim 2 further comprising an opposite indented portion of the surface of a back face extending from the end of said first header of each of said plurality of masonry articles, said indented portion of the surface of said contoured front face of greater width compared to said opposite indented portion of the surface of said back face, a first opposite projecting portion of said second header of each of said plurality of masonry articles and a second opposite projecting portion of said second header of each of said plurality of masonry articles having substantially the same width as the width of said opposite indented portion of the surface of said back face of said first header of each of said plurality of masonry articles, so that when each of said plurality of masonry articles couples adjacently to one other of said plurality of masonry articles, said indented portion of said contoured front face of each of said plurality of masonry articles provides the appearance of a vertically oriented mortar-like gap.

4. The plurality of masonry articles according to claim 3 further comprising said back face substantially parallel to said contoured front face, a lower portion of said indented portion of the surface of said contoured front face having a substantially L-shaped step, a lower portion of said back face comprising a substantially opposite L-shaped step, said opposite L-shaped step of the back face and said L-shaped step of the contoured front face having substantially the same height, so that when the portion of said contoured upper base of each of said plurality of masonry articles couples to the portion of said lower base of one of said other plurality of masonry articles the outward face of the portion of the wall assembled with all of said plurality of masonry articles has the appearance of the mortar-like horizontally oriented gap.

5. The plurality of masonry articles according to claim 1 further comprising said contoured upper base of each of said plurality of masonry articles comprising a channel extending substantially horizontally from said first header to said second header of each of said plurality of masonry articles and when the portion of said lower base of said plurality of masonry articles couples to the portion of said contoured upper base of one other of said plurality of masonry articles said channel providing an opening, said opening for accommodating a substantially horizontally oriented reinforcing rod end said opening for accommodating mortar.

6. The plurality of masonry articles according to claim 1 wherein each of said plurality of masonry articles has at least one hole extending from said upper base to said contoured lower base, each of said at least one hole for accommodating a substantially vertically oriented reinforcing rod within each of said at least one hole and for accommodating mortar within each of said at least one hole.

7. The plurality of masonry articles according to claim 1 wherein the distance between each of said plurality of masonry articles adjacently coupled to one other of said plurality of masonry articles is selectively adjustable to accommodate variations in length of a course of the plurality of masonry articles of the portion of the wall.

8. A collection of interlocking masonry articles comprising, in combination:

a plurality of masonry articles also comprising a plurality of corner masonry articles and a plurality of alternative corner masonry articles, said plurality of masonry articles, said plurality of corner masonry articles and said plurality of alternative corner masonry articles together providing contoured shapes so that an outward face of a portion of a wall assembled with said plurality of masonry articles, said plurality of corner masonry articles and said plurality of alternative corner masonry articles provide the appearance of a plurality of mortar-like horizontally oriented and mortar-like vertically oriented gaps;

each of said plurality of corner masonry articles comprises a first corner header and a second corner header, a contoured portion of said first corner header of each of said plurality of corner masonry articles for coupling to a contoured portion of a second header of said plurality of masonry articles, and a contoured portion of said second corner header of each one of said plurailty of corner masonry articles for coupling to a contoured portion of one other first header of one other of said plurality of masonry articles so that an outward face of a corner portion of a wall assembled with said plurality of corner masonry articles and said plurality of masonry articles has a mortar-like vertically oriented gap;

said plurality of corner masonry articles when assembled to provide a corner portion of the wall having a contoured front face, said plurality of corner masonry articles when assembled to provide a corner portion of the wall having a lower base and a contoured upper base of each of said plurality of corner masonry articles configured for coupling a portion of said contoured upper base of each of said plurality of corner masonry articles to a portion of a lower base of each of a combination of one of said plurality of alternative corner masonry articles coupled to one of said plurality of masonry articles so that the outward face of the corner portion of the wall assembled with all of said plurality of interlocking masonry articles has a mortar-like horizontally oriented gap;

said plurality of corner masonry articles having a back face substantially parallel to said contoured front face of each of said plurality of corner masonry articles, said first corner header of each of said plurality of corner masonry articles comprising a first projecting portion, a second projecting portion and an end-recessed portion for each of said plurality of corner masonry articles, said end-recessed portion located between said first projecting portion and said second projecting portion of said first corner header of each of said plurality of corner masonry articles, said first corner header of each of said plurality of corner masonry articles projecting substantially perpendicularly from a portion of said back face of each of said plurality of corner masonry articles; and said second corner header of each of said plurality of corner masonry articles comprising a first opposite projecting portion, a second opposite projecting portion, a first inner recessed portion, a second inner recessed portion and an opposite recessed portion for each of said plurality of corner masonry articles, said first opposite projecting portion adjacent to said first inner recessed portion of said second corner header of each of said plurality of corner masonry articles, said second opposite projecting portion adjacent to said second inner recessed portion of said second corner header of each of said plurality of corner masonry articles, said opposite recessed portion located between said first inner recessed portion and said second inner recessed portion of said second corner header of each of said plurality of corner masonry articles, so that said first corner header of each of sad plurality of corner masonry articles couples to said second header of one of said plurality of masonry articles and said second corner header of each of said plurality of corner masonry articles couples to one other first header of one other of said plurality of masonry articles to provide the corner portion of the wall.

9. The collection of interlocking masonry articles according to claim 8 wherein said plurality of masonry articles comprises a first header and a second header for each of said plurality of masonry articles, a contoured portion of said first header of each of said plurality of masonry articles for coupling to a contoured portion of another second header of another one of said plurality of masonry articles, and a contoured portion of said second header of each one of said plurality of masonry articles for coupling to a contoured portion of one other first header of one other of said plurality of masonry articles so that an outward face of a portion of a wall assembled with said plurality of masonry articles has a mortar-like vertically oriented gap; said plurality of masonry articles when assembled to provide a portion of the wall having a contoured front face, said plurality of masonry articles when assembled to provide a portion of the wall having a lower base and a contoured upper base of each of said plurality of masonry articles configured for coupling a portion of said contoured upper base of each of said plurality of masonry articles to a portion of a lower base of one of the other plurality of masonry articles so that the outward face of the portion of the wall assembled with all of said plurality of masonry articles has a mortar-like horizontally oriented gap.

10. The collection of interlocking masonry articles according to claim 9 further comprising a corner end of each of said plurality of corner masonry articles, said corner end opposite said second corner header of each of said plurality of corner masonry articles, said corner end of each of said plurality of corner masonry articles having a front-end face, a surface of said front-end face of said corner end of each of said plurality of corner masonry articles having an elevated portion and said elevated portion of the surface of said front-end face of said corner end of each of said plurality of corner masonry articles adjacent to an indented portion of the surface of said front-end face of said corner end of each of said plurality of corner masonry articles, said indented portion of the surface of said front-end face of said corner end of each of said plurality of corner masonry articles extending from said first corner header to said contoured front face of each of said plurality of corner masonry articles;

a surface of said contoured front face of each of said plurality of corner masonry articles having an elevated portion and said elevated portion of the surface of said contoured front face of each of said plurality of corner masonry articles adjacent to an indented portion of the surface of said contoured front face of each of said plurality of corner masonry articles, said indented portion of said contoured front face of each of said plurality of corner masonry articles extending from said corner end to said second corner header of each of said plurality of corner masonry articles so that the outward face of the corner portion of the wall assembled with said plurality of corner masonry articles provide the appearance of the mortar-like vertically oriented gap and the mortar-like horizontally oriented gap.

11. The collection of interlocking masonry articles according to claim 10 further comprising a back end face of said corner end of each of said plurality of corner masonry articles having an opposite indented portion of the surface of said back end face of said corner end, said opposite indented portion extending from an end of said second horizontally projecting portion of said first corner header of each of said plurality of corner masonry articles, said indented portion of the surface of said front-end face of said corner end of each of said plurality of corner masonry articles of greater width compared to said opposite indented portion of the surface of said back end face of said corner end of each of said plurality of corner masonry articles, a first opposite projecting portion of said second header of each of said plurality of masonry articles and a second opposite projecting portion of said second header of each of said plurality of masonry articles having substantially the same width as the width of said opposite indented portion of the surface of said back end face of said corner end of each of said plurality of corner masonry articles, so that when said first header of one of said plurality of corner masonry articles couples adjacently to said second header of one of said plurality of masonry articles, said indented portion of said front-end face of said corner end of each of said plurality of corner masonry articles provides the appearance of a vertically oriented mortar-like gap.

12. The collection of interlocking masonry articles according to claim 11 further comprising said back face of each of said plurality of corner masonry articles substantially parallel to said contoured front face of each of said plurality of corner masonry articles, said back end face of said corner end each of said plurality of corner masonry articles substantially parallel to said front-end face of said corner end of each of said plurality of corner masonry articles, a lower portion of said indented portion of the surface of said contoured front face of each of said plurality of corner masonry articles substantially parallel to said contoured front face of each of said plurality of corner masonry articles having a substantially L-shaped step, a lower portion of said indented portion of said contoured end face of said corner end of each of said plurality of corner masonry articles substantially parallel to said contoured end face of said corner end of each of said plurality of corner masonry articles having a substantially L-shaped step, a lower portion of said back face substantially parallel to said contoured front face of each of said plurality of corner masonry articles comprising a substantially opposite L-shaped step and a lower portion of said back end face of said corner end back face of each of said plurality of corner masonry articles substantially parallel to said contoured end face of said corner end of each of said plurality of corner masonry articles comprising a substantially opposite L-shaped step, said opposite L-shaped step of said back face, said opposite L-shaped step of said back end face of said corner end, said L-shaped step of said contoured front face and said L-shaped step of said front-end face of said corner end of each of said plurality of corner masonry articles having substantially the same height, so that when the portion of said contoured upper base of each of said corner plurality of masonry articles couples to the portion of said lower base of each of a combination of one of said plurality of alternative corner masonry articles coupled to one of said plurality of masonry articles the outward face of the corner portion of the wall assembled with all of said plurality of interlocking masonry articles has the appearance of the mortar-like horizontally oriented gap.

13. The collection of interlocking masonry articles according to claim 9 wherein each of said plurality of alternative corner masonry articles comprises a first alternative corner header and a second alternative corner header, a contoured portion of said first alternative corner header of each of said plurality of alternative corner masonry articles for coupling to a contoured portion of a second header of said plurality of masonry articles, and a contoured portion of said second alternative corner header of each one of said plurality of alternative corner masonry articles for coupling to a contoured portion of one other first header of one other of said plurality of masonry articles so that an outward face of an alternative corner portion of a wall assembled with said plurality of alternative corner masonry articles and said plurality of masonry articles has a mortar-like vertically oriented gap;

said plurality of alternative corner masonry articles when assembled to provide an alternative corner portion of the wall having a contoured front face of each of said plurality of alternative corner articles, said plurality of alternative corner masonry articles when assembled to provide an alternative corner portion of the wall having a lower base and a contoured upper base of each of said plurality of alternative corner masonry articles configured for coupling a portion of said contoured upper base of each of said plurality of alternative corner masonry articles to a portion of a lower base of each of a combination of one of said plurality of corner masonry articles coupled to one of said plurality of masonry articles so that the outward face of the alternative corner portion of the wall assembled with all of said plurality of interlocking masonry articles has a mortar-like horizontally oriented gap.

14. The collection of interlocking masonry articles according to claim 9 further comprising said plurality of alternative corner masonry articles having a back face substantially parallel to said contoured front face of each of said plurality of alternative corner masonry articles, said first alternative corner header of each of said plurality of alternative corner masonry articles comprising a first projecting portion, a second projecting portion and an end-recessed portion for each of said plurality of alternative corner masonry articles, said end-recessed portion located between said first projecting portion and said second projecting portion of said first corner header of each of said plurality of alternative corner masonry articles;

said second alternative corner header of said plurality of alternative corner masonry articles comprising a first opposite projecting portion, a first inner recessed portion, a second inner recessed portion and an opposite recessed portion, said first opposite projecting portion adjacent to said first inner recessed portion of said second alternative corner header of each of said plurality of alternative corner masonry articles, said second inner recessed portion adjacent to said contoured front face of each of said plurality of corner masonry articles, said opposite recessed portion located between said first inner recessed portion and said second inner recessed portion of said second alternative corner header of each of said plurality of alternative corner masonry articles, said second alternative corner header of said plurality of alternative corner masonry articles located on a portion of said back face of each of said plurality of alternate corner masonry articles, so that said first alternative corner header of each of said plurality of alternative corner masonry articles couples to said second header of one of said plurality of masonry articles and said second alternative corner header of each of said plurality of alternative corner masonry articles couples to one other first header of one other of said plurality of masonry articles to provide the alternative corner portion of the wall.

15. The collection of interlocking masonry articles according to claim 14 further comprising an alternative corner end of each of said plurality of alternative corner masonry articles, said alternative corner end opposite said first alternative corner header of each of said plurality of alternative corner masonry articles, said alternative corner end of each of said plurality of alternative corner masonry articles having a front-end face, a surface of said front-end face of said alternative corner end of each of said plurality of alternative corner masonry articles having an elevated portion and said elevated portion of the surface of said front-end face of said alternative corner end of each of said plurality of alternative corner masonry articles adjacent to an indented portion of the surface of said front-end face of said alternative corner end of each of said plurality of alternative corner masonry articles, said indented portion of the surface of said front-end face of said alternative corner end of each of said plurality of alternative corner masonry articles extending from said second alternative corner header to said contoured front face of each of said plurality of alternative corner masonry articles; a surface of said contoured front face of each of said plurality of alternative corner masonry articles having an elevated portion and said elevated portion of the surface of said contoured front face of each of said plurality of alternative corner masonry articles adjacent to an indented portion of the surface of said contoured front face of each of said plurality of alternative corner masonry articles, said indented portion of said contoured front face extending from said alternative corner end to said first alternative corner header of each of said plurality of alternative corner masonry articles so that the outward face of the alternative corner portion of the wall assembled with said plurality of alternative corner masonry articles provide the appearance of the mortar-like vertically oriented gap and the mortar-like horizontally oriented gap.

16. The collection of interlocking masonry articles according to claim 9 wherein each of said interlocking masonry articles has a first header, a second header, a contoured upper base and a lower base, said contoured upper base of each of said interlocking masonry articles comprising a channel extending substantially horizontally from said first header to said second header of each of said interlocking masonry articles and when a portion of said contoured upper base of one of said interlocking masonry articles couples to a portion of said lower base of a combination of a plurality of said interlocking masonry articles said channel providing an opening, said opening for accommodating a reinforcing rod and said opening for accommodating mortar.

17. The collection of interlocking masonry articles according to claim 16 wherein each of said interlocking masonry articles has at least one hole extending from said upper base to said contoured lower base of each of said interlocking masonry articles, each of said at least one hole for accommodating a substantially vertically oriented reinforcing rod within each of said at least one hole and for accommodating mortar within each of at least one hole.

18. A method for assembling a portion of a wall comprising the steps of:

providing a first header and a second header for each of a plurality of masonry articles, said first header of each of said plurality of masonry articles comprising a first projecting portion, a second projecting portion and an end-recessed portion of each of said plurality of masonry articles, said end-recessed portion located between said first projecting portion and said second projecting portion of said first header of each of said plurality of masonry articles and said second header of each of said plurality of masonry articles comprising a first opposite projecting portion, a second opposite projecting portion, a first inner recessed portion, a second inner recessed portion and an opposite recessed portion of each of said plurality of masonry articles, said first opposite projecting portion adjacent to said first inner recessed portion of said second header of each of said plurality of masonry articles, said second opposite projecting portion adjacent to said second inner recessed portion of said second header of each of said plurality of masonry articles, said opposite recessed portion located between said first inner recessed portion and said second inner recessed portion of said second header of each of said plurality of masonry articles so that said first header of each of said plurality of masonry articles couples to one other second header of one other of said plurality of masonry articles and said second header of each of said plurality of masonry articles couples to said other first header of one other of said plurality of masonry articles to provide the portion of the wall;

coupling a contoured portion of said first header of each of said plurality of masonry articles to a contoured portion of another second header of another one of said plurality of masonry articles;

coupling a contoured portion of said second header of each one of said plurality of masonry articles to a contoured portion of one other first header of one other of said plurality of masonry articles so that an outward face of a portion of a wall assembled with said plurality of masonry articles has a mortar-like vertically oriented gap;

assembling said plurality of masonry articles to provide a portion of the wall having a contoured front face, each of said plurality of masonry articles having a lower base and a contoured upper base, said contoured upper base of each of said plurality of masonry articles comprising a channel extending substantially horizontally from said first header to said second header of each of said plurality of masonry articles; and coupling a portion of said contoured upper base of each of said plurality of masonry articles to a portion of a lower base of one of the other plurality of masonry articles so that the outward face of the portion of the wall assembled with all of said plurality of masonry articles has a mortar-like horizontally oriented gap.

19. The method according to claim 18 further comprising the steps of:

coupling the portion of said lower base of said plurality of masonry articles to the portion of said contoured upper base of one other of said plurality of masonry articles, said channel of each one of said plurality of masonry articles defining an opening;

providing each one of said plurality of masonry articles has at least one hole extending from said upper base to said contoured lower base;

off-setting a course of said plurality of masonry articles relative to another course of said plurality of masonry articles, each one of said plurality of masonry articles of said another course having at least one hole to vertically align said at least one hole of said course of said plurality of masonry articles to said at least one hole of said another course of said plurality of masonry articles;

providing at least one substantially vertically oriented reinforcing rod;

providing at least one substantially horizontally oriented reinforcing rod;

positioning said at least one substantially horizontally oriented reinforcing rod within said opening of at least one of said plurality of masonry articles;

positioning said at least one substantially vertically oriented reinforcing rod within said at least one hole of at least one of said plurality of masonry articles; and pouring mortar into said at least one hole to substantially fill said opening of each one of said plurality of masonry articles thereby adhering said course of said plurality of masonry articles to said another course of said plurality of masonry articles when the mortar sets.

* * * * *